US005759628A

United States Patent [19]

Garcia, Jr.

[11] Patent Number: 5,759,628

[45] Date of Patent: Jun. 2, 1998

[54] APPARATUS AND METHOD FOR APPLYING FILLER MATERIAL

[76] Inventor: Oscar A. Garcia, Jr., 4625 E. Grove St., Phoenix, Ariz. 85040

[21] Appl. No.: 746,095

[22] Filed: Nov. 6, 1996

[51] Int. Cl.[6] ..... B05D 1/40; B05C 1/06

[52] U.S. Cl. ..... 427/356; 15/235.4; 15/245.1; 425/458; D8/16; D8/45

[58] Field of Search ..... 15/235.4, 236.01, 15/236.02, 236.05, 245.1; 425/458; 427/356; D8/16, 19, 45

[56] References Cited

U.S. PATENT DOCUMENTS

| | | | |
|---|---|---|---|
| 3,178,747 | 4/1965 | Peterson | 15/236.01 |
| 3,363,316 | 1/1968 | Skarsten | 15/236.05 X |
| 4,097,951 | 7/1978 | Hurtt | 15/245.1 |
| 4,307,481 | 12/1981 | Phares | 15/245.1 X |
| 4,784,598 | 11/1988 | Kranz et al. | 425/458 |

FOREIGN PATENT DOCUMENTS

| | | | |
|---|---|---|---|
| 622432 | 5/1927 | France | 15/235.4 |

*Primary Examiner*—Mark Spisich

[57] ABSTRACT

An apparatus and method for applying filler material comprising a spreader tool having a front edge, a rear edge, and a pair of short side edges situated therebetween. The spreader tool has a first portion positioned adjacent the front edge. The first portion is slightly bevelled downwardly with respect to a horizonal plane from a point positioned rearward of the front edge about 10% the length of the spreader to the front edge. A second portion is positioned adjacent the first portion. The second portion is bevelled upwardly with respect to the horizontal plane from a point positioned rearward of the front edge about 40% the length of the spreader to a point positioned rearward of the front edge about 10% the length of the spreader. A third portion is positioned adjacent the second portion. The third portion is bevelled downwardly with respect to the horizontal plane from a point positioned rearward of the front edge about 80% the length of the spreader to a point positioned rearward of the front edge about 40% the length of the spreader.

6 Claims, 3 Drawing Sheets

APPARATUS AND METHOD FOR APPLYING FILLER MATERIAL

BACKGROUND OF THE INVENTION

1. Field of the Invention

The present invention relates to an apparatus and method for applying filler material and more particularly pertains to applying filler material with a specially adapted spreader tool and collector tool.

2. Description of the Prior Art

The use of spreader tools is known in the prior art. More specifically, spreader tools heretofore devised and utilized for the purpose of distributing caulking within areas are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,097,951 to Hurtt; U.S. Pat. No. 5,351,357 to Liberman; U.S. Patent Des. 343,100 to Jenkinson et al.; U.S. Pat. No. 5,437,076 to Vasquez; U.S. Pat. No. 4,654,919 to Liberman; and U.S. Pat. No. 4,054,962 to Janke are provided as being of general interest.

In this respect, the apparatus and method for applying filler material according to the present invention substantially departs from the conventional concepts and designs of the prior art, and in so doing provides an apparatus primarily developed for the purpose of applying filler material with a specially adapted spreader tool and collector tool.

Therefore, it can be appreciated that there exists a continuing need for a new and improved apparatus and method for applying filler material which can be used for applying filler material with a specially adapted spreader tool and collector tool. In this regard, the present invention substantially fulfills this need.

SUMMARY OF THE INVENTION

In view of the foregoing disadvantages inherent in the known types of spreader tools now present in the prior art, the present invention provides an improved apparatus and method for applying filler material. As such, the general purpose of the present invention, which will be described subsequently in greater detail, is to provide a new and improved apparatus and method for applying filler material which has all the advantages of the prior art and none of the disadvantages.

To attain this, the present invention essentially comprises a thin spreader tool with a generally rectangular configuration. The spreader tool has a long front edge, a long rear edge, and a pair of short side edges situated therebetween. As best shown in FIG. 3, the spreader tool has a first portion positioned adjacent the long front edge. The first portion is slightly bevelled downwardly with respect to a horizonal plane from a point positioned rearward of the front edge about 10% the length of the spreader to the front edge. A second portion is positioned adjacent the first portion. The second portion is bevelled upwardly with respect to the horizontal plane. Such bevelling extends from a point positioned rearward of the front edge about 40% the length of the spreader to a point positioned rearward of the front edge about 10% the length of the spreader. An interconnection of the first portion and the second portion affords a slightly arcuate spreading surface for evenly spreading filler material within a damaged area. The spreader tool further has a third portion positioned adjacent the second portion. The third portion is bevelled downwardly with respect to the horizontal plane from a point positioned rearward of the front edge about 80% the length of the spreader to a point positioned rearward of the front edge about 40% the length of the spreader. An interconnection of the second portion and the third portion affords a basin for collecting excess filler material while spreading the filler material within the damaged area. A fourth portion is positioned adjacent the third portion, wherein the fourth portion bevelled upwardly with respect to the horizontal plane from the rear edge to a point positioned rearward of the front edge about 80% the length of the spreader. An interconnection of the third portion and the fourth portion afford improved gripping capabilities.

There has thus been outlined, rather broadly, the more important features of the invention in order that the detailed description thereof that follows may be better understood , and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employ ed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invent ion. It is important, therefore, that the claims be regarded as including such equivalent constructions insofar as they do not depart from the spirit and scope of the present invention.

It is therefore an object of the present invention to provide a new and improved apparatus and method for applying filler material which has all the advantages of the prior art spreader tools and none of the disadvantages.

It is another object of the present invention to provide a new and improved apparatus and method for applying filler material which may be easily and efficiently manufactured and marketed.

It is a further object of the present invention to provide a new and improved apparatus and method for applying filler material which is of a durable and reliable construction.

An even further object of the present invention is to provide a new and improved apparatus and method for applying filler material which is susceptible of a low cost of manufacture with regard to both materials and labor, and which accordingly is then susceptible of low prices of sale to the consuming public, thereby making such apparatus and method for applying filler material economically available to the buying public.

Still yet another object of the present invention is to provide a new and improved apparatus and method for applying filler material which provides in the apparatuses and methods of the prior art some of the advantages thereof, while simultaneously overcoming some of the disadvantages normally associated therewith.

Still another object of the present invention is to apply filler material with a specially adapted spreader tool and collector tool.

Lastly, it is an object of the present invention to provide a new and improved apparatus and method for applying filler material comprising a spreader tool having a front edge, a rear edge, and a pair of short side edges situated therebetween. The spreader tool has a first portion positioned adjacent the front edge. The first portion is slightly bevelled downwardly with respect to a horizonal plane from a point positioned rearward of the front edge about 10% the length of the spreader to the front edge. A second portion is positioned adjacent the first portion. The second portion is bevelled upwardly with respect to the horizontal plane from a point positioned rearward of the front edge about 40% the length of the spreader to a point positioned rearward of the front edge about 10% the length of the spreader. A third portion is positioned adjacent the second portion. The third portion is bevelled downwardly with respect to the horizontal plane from a point positioned rearward of the front edge about 80% the length of the spreader to a point positioned rearward of the front edge about 40% the length of the spreader.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
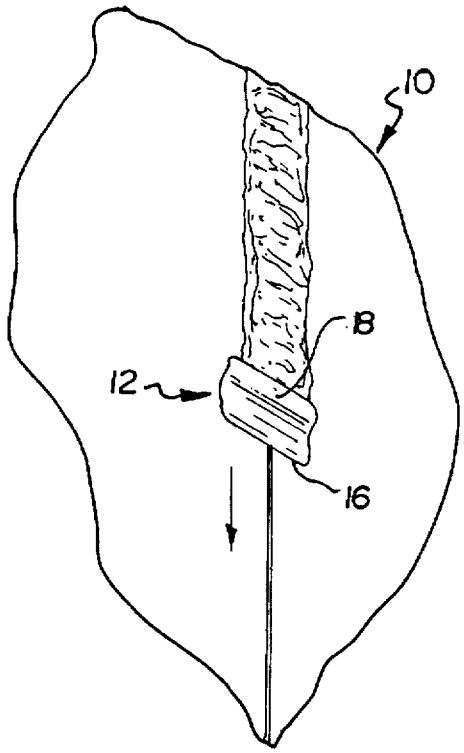
FIG. 1 is a perspective illustration of the preferred embodiment of the apparatus and method for applying filler material constructed in accordance with the principles of the present invention.
Figure 2:
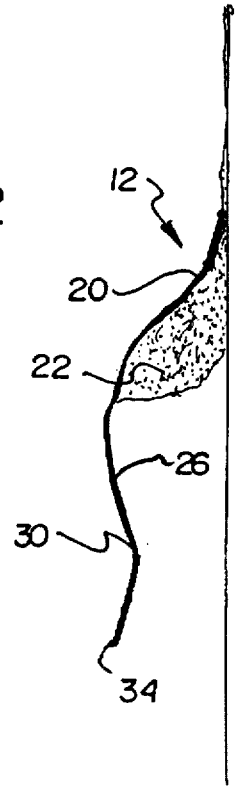
FIG. 2 is a side plan view of the present invention in use.

With reference now to the drawings, and in particular to FIG. 1 thereof, a new and improved apparatus and method for applying filler material embodying the principles and concepts of the present invention and generally designated by the reference numeral 10 will be described.

The present invention, the new and improved apparatus and method for applying filler material, is comprised of a plurality of components. Such components in their broadest context include a spreader tool and a collector tool. Such components are individually configured and correlated with respect to each other so as to attain the desired objective.

More specifically, it will be noted that the system 10 of the present invention includes a thin spreader tool 12 with a generally rectangular configuration having rounded edges. The spreader tool has a long front edge 14, a long rear edge 16, and a pair of short side edges 18 situated therebetween. The long front and rear edges are ideally between a length of 6 and 12 inches and the short side edges are approximately 2 and ½ inches. The spreader tool is preferably constructed of a tin material. The material from which the spreader tool is ⅛ constructed allows the width thereof to be approximately ⅛ of an inch. It should be note that the foregoing specific dimensions may be augmented to accommodate various tasks without departing from the scope of the present invention as long as the associated proportions and ratios are present.

Figure 3:
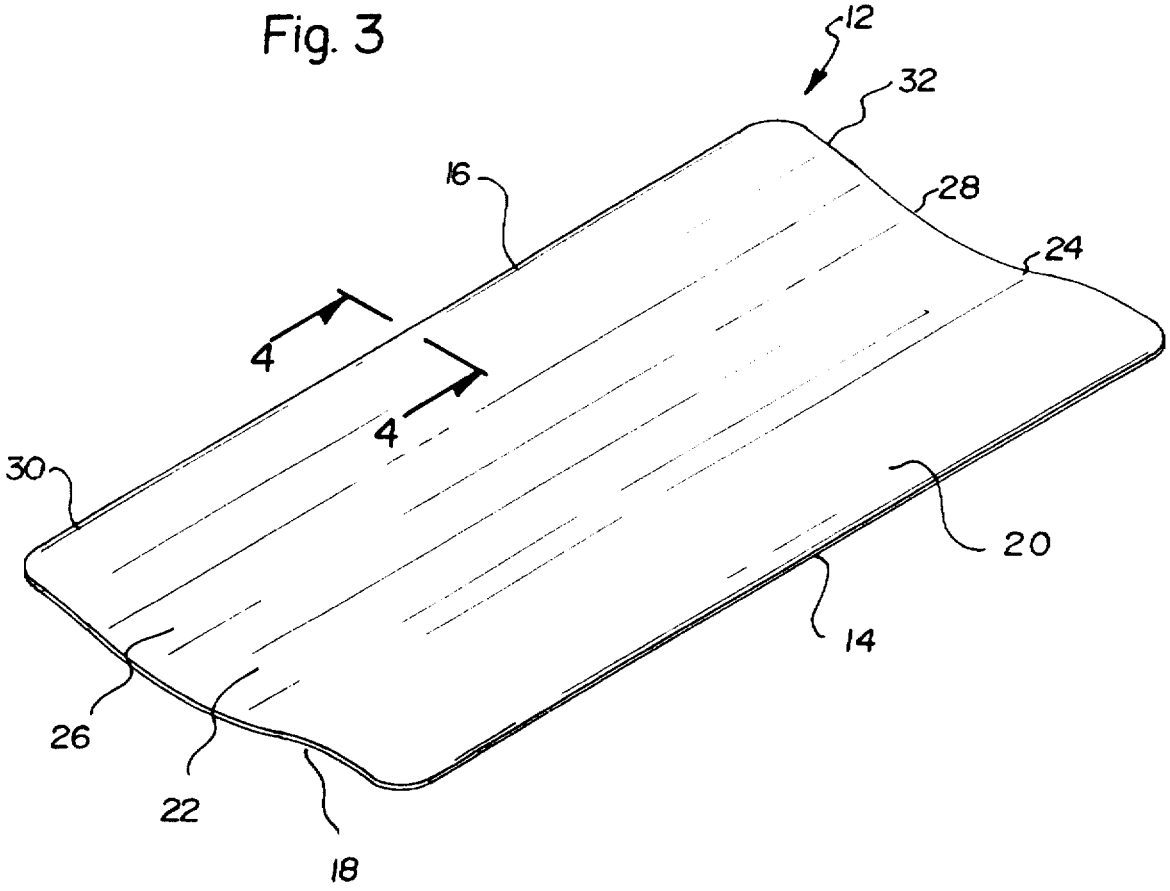
FIG. 3 is a perspective view of the present invention depicting the basin.

As best shown in FIG. 3, the spreader tool has a first portion 20 positioned adjacent the long front edge. The first portion is slightly bevelled downwardly with respect to a horizonal plane from a point positioned rearward of the front edge about 10% the length of the spreader to the front edge. A second portion 22 is positioned adjacent the first portion. The second portion is bevelled upwardly with respect to the horizontal plane. Such bevelling extends from a point positioned rearward of the front edge about 40% the length of the spreader to a point positioned rearward of the front edge about 10% the length of the spreader. An interconnection 24 of the first portion and the second portion affords a slightly arcuate spreading surface for evenly spreading filler material within a damaged area. The spreader tool further has a third portion 26 positioned adjacent the second portion. The third portion is bevelled downwardly with respect to the horizontal plane from a point positioned rearward of the front edge about 80% the length of the spreader to a point positioned rearward of the front edge about 40% the length of the spreader. The beveling of the third portion is not as steep as that of the second portion. An interconnection 28 of the second portion and the third portion affords a basin for collecting excess filler material while spreading the filler material within the damaged area. A fourth portion 30 is positioned adjacent the third portion, wherein the fourth portion is bevelled upwardly with respect to the horizontal plane from the rear edge to a point positioned rearward of the front edge about 80% the length of the spreader. An interconnection 32 of the third portion and the fourth portion afford improved gripping capabilities. Preferably, the plane containing the interconnection 24 of the first portion and the second portion and the interconnection 32 of the third portion and the fourth portion resides a shortest distance of ½ an inch from the interconnection 28 of the second portion and third portion.

Figure 4:
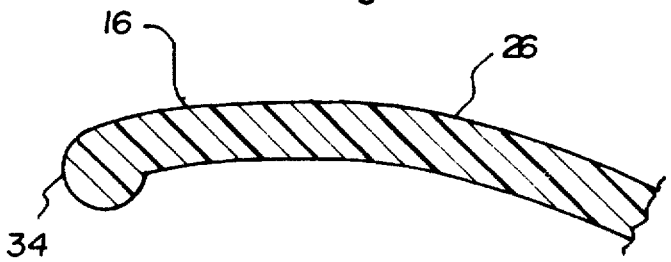
FIG. 4 is an exploded cross-sectional view taken along line 4—4 shown in FIG. 3 showing an optional bulb.

As an option, as shown in FIG. 4, the spreader tool further comprises a bulb-shaped lip 34 formed on the rear edge of the spreader tool. The bulb-shaped lip also contributes to the improved gripping capabilities.

Figure 5:
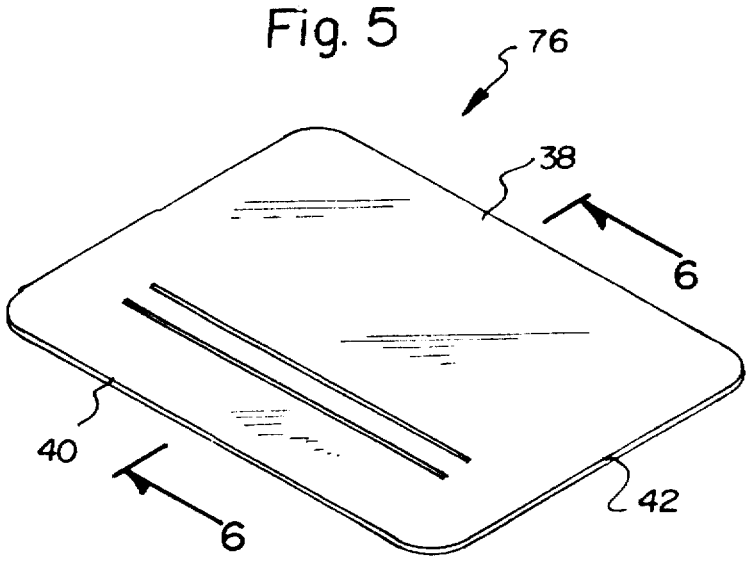
FIG. 5 is a perspective view of the collector tool of the present invention.
Figure 6:
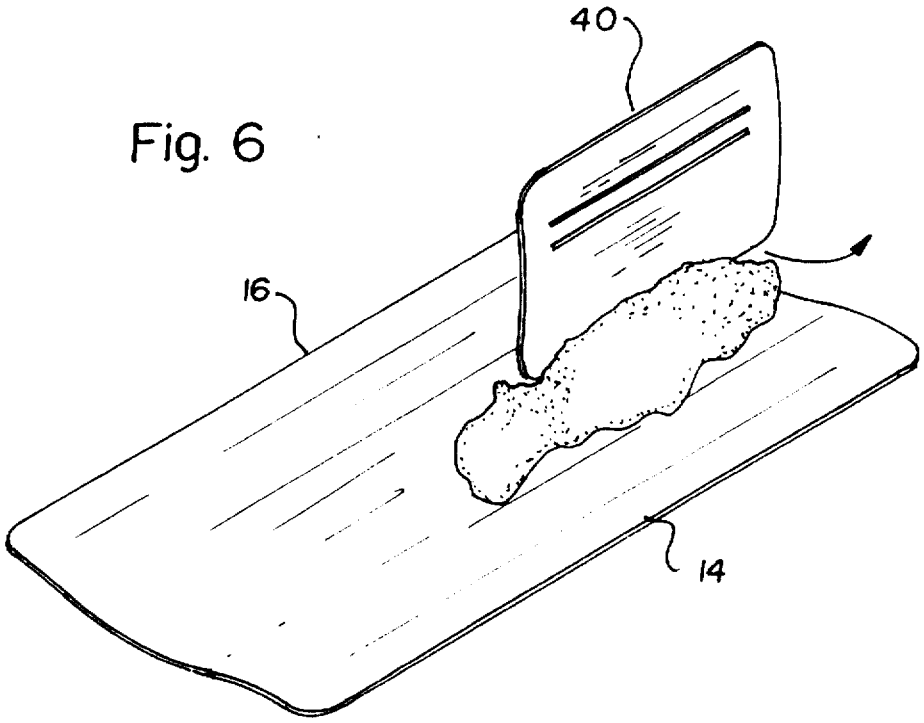
FIG. 6 is a perspective view of the collector tool in use.

As shown in FIGS. 5 and 6, a thin collector tool 38 is provided. The collector tool has a generally rectangular configuration having a long front edge 38, a long rear edge 40, and a pair of short side edges 42 situated therebetween. The length of the thin collector tool is less than half the length of the spreader tool. The collector tool has a plurality of optional grooves 44 formed in a top surface thereof adjacent to and parallel with the rear edge thereof.

In use, a unique method is afforded by providing the aforementioned components. A user first grips the spreader tool with the thumb positioned on a lower surface of the fourth portion thereof adjacent the bulb-shaped lip. The user then places a plurality of fingers on an upper surface of the third portion. Next the user abuts the interconnection 24 of the first portion and second portion of the spreader tool against a damaged area in a flat surface. The flat surface should have loose filler material situated about the area. The user then slides the spreading tool along the area and collects filler material within the basin of the spreader tool. After such, the user grips the collector tool via the grooves thereof and remove the excess filler material within the basin of the spreader tool. As such, the user may then reapply the excess filler material to the area of the surface.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact size, construction, and operation shown and described, and accordingly, all suitable modifications and equivalents may be resorted to, falling within the scope of the invention.

What is claimed as being new and desired to be protected by letters patent of the united states is as follows:

1. A new and improved apparatus for applying filler material comprising a thin spreader tool with a generally rectangular configuration having a long front edge, a long rear edge, and a pair of short side edges situated therebetween, the spreader tool having a first portion positioned adjacent the long front edge with the first portion slightly bevelled downwardly with respect to a horizonal plane from a point positioned rearward of the front edge about 10% the length of the spreader to the front edge, a second portion positioned adjacent the first portion with the second portion bevelled upwardly with respect to the horizontal plane from a point positioned rearward of the front edge about 40% the length of the spreader to a point positioned rearward of the front edge about 10%,the length of the spreader, a third portion positioned adjacent the second portion with the third portion bevelled downwardly with respect to the horizontal plane from a point positioned rearward of the front edge about 80% the length of the spreader to a point positioned rearward of the front edge about 40% the length of the spreader, and a fourth portion positioned adjacent the third portion with the fourth portion bevelled upwardly with respect to the horizontal plane from the rear edge to a point positioned rearward of the front edge about 80% the length of the spreader, whereby an interconnection of the first portion and the second portion affords a slightly arcuate spreading surface for evenly spreading filler material within an area, an interconnection of the second portion and the third portion affords a basin for collecting excess filler material while spreading the filler material within the area, and an interconnection of the third portion and the fourth portion afford improved gripping capabilities.

2. An apparatus for applying filler material comprising a spreader tool having a front edge, a rear edge, and a pair of short side edges situated therebetween, the spreader tool having a first portion positioned adjacent the front edge with the first portion slightly bevelled downwardly with respect to a horizonal plane from a point positioned rearward of the front edge about 10% the length of the spreader to the front edge, a second portion positioned adjacent the first portion with the second portion bevelled upwardly with respect to the horizontal plane from a point positioned rearward of the front edge about 40% the length of the spreader to a point positioned rearward of the front edge about 10% the length of the spreader, and a third portion positioned adjacent the second portion with the third portion bevelled downwardly with respect to the horizontal plane from a point positioned rearward of the front edge about 80% the length of the spreader to a point positioned rearward of the front edge about 40% the length of the spreader.

3. An apparatus for applying filler material as set forth in claim 2 wherein the spreader tool is thin.

4. An apparatus for applying filler material as set forth in claim 2 wherein the spreader tool further includes a fourth portion positioned adjacent the third portion with the fourth portion bevelled upwardly with respect to the horizontal plane from the rear edge to a point positioned rearward of the front edge about 80% the length of the spreader.

5. An apparatus for applying filler material as set forth in claim 2 wherein the spreader tool further includes a bulb-shaped lip formed on the rear edge thereof.

6. A method of distributing filler material comprising the steps of:

providing a thin spreader tool with a generally rectangular configuration having a long front edge, a long rear edge, and a pair of short side edges situated therebetween with the long front edge having a predetermined length, the spreader tool having a first portion positioned adjacent the long front edge with the first portion slightly bevelled downwardly with respect to a horizonal plane from a point positioned rearward of the front edge about 10% the length of the spreader to the front edge, a second portion positioned adjacent the first portion with the second portion bevelled upwardly with respect to the horizontal plane from a point positioned rearward of the front edge about 40% the length of the spreader to a point positioned rearward of the front edge about 10% the length of the spreader, a third portion positioned adjacent the second portion with the third portion bevelled downwardly with respect to the horizontal plane from a point positioned rearward of the front edge about 80% the length of the spreader to a point positioned rearward of the front edge about 40% the length of the spreader, and a fourth portion positioned adjacent the third portion with the fourth portion bevelled upwardly with respect to the horizontal plane from the rear edge to a point positioned rearward of the front edge about 80% the length of the spreader, whereby an interconnection of the first portion and the second portion affords a slightly arcuate spreading surface for evenly spreading filler material within an area, and an interconnection of the second portion and the third portion affords a basin for collecting excess filler material while spreading the filler material within the area;

providing a thin collector tool with a generally rectangular configuration having a long front edge, a long rear edge, and a pair of short side edges situated therebetween with the length of the thin collector tool being less than half of the predetermined length;

gripping the spreader tool with the thumb positioned on the fourth portion thereof and a plurality of fingers positioned on the third portion;

abutting the interconnection of the first portion and the second portion of the spreader tool against a damaged area of a flat surface, wherein there is loose filler material situated about the area;

sliding the spreading tool along the area and collecting filler material within the basin of the spreader tool;

gripping the collector tool and removing excess filler material within the basin of the spreader tool; and reapplying the excess filler material to the area of the surface.

* * * * *